US005642544A

United States Patent [19]

Muñoz

[11] Patent Number: 5,642,544

[45] Date of Patent: Jul. 1, 1997

[54] HYDRAULIC PILLOW

[76] Inventor: Rosario Castro Muñoz, Pintor Astorza Y Triay, 14 - 1º A, E-03015 Alicante, Spain

[21] Appl. No.: 656,173

[22] PCT Filed: Oct. 10, 1995

[86] PCT No.: PCT/ES95/00112

§ 371 Date: Jun. 7, 1996

§ 102(e) Date: Jun. 7, 1996

[87] PCT Pub. No.: WO96/11617

PCT Pub. Date: Apr. 25, 1996

[30] Foreign Application Priority Data

Oct. 14, 1994 [ES] Spain ..... 9402714 U

[51] Int. Cl.[6] ..... A47G 9/00; A47C 27/10

[52] U.S. Cl. ..... 5/644; 5/655.5

[58] Field of Search ..... 5/644, 654, 655.3, 5/710, 655.5, 665

[56] References Cited

U.S. PATENT DOCUMENTS

| | | | |
|---|---|---|---|
| 2,604,641 | 7/1952 | Reed | 5/710 |
| 3,503,084 | 3/1970 | Meinwieser | 5/655.3 |
| 3,644,949 | 2/1972 | Diamond | 5/710 |
| 3,983,587 | 10/1976 | Gorran . | |
| 4,247,963 | 2/1981 | Reddi . | |
| 4,389,742 | 6/1983 | DeWitt . | |
| 4,405,129 | 9/1983 | Stuckey | 5/654 |
| 4,685,163 | 8/1987 | Quillen et al. | 5/644 |
| 5,044,030 | 9/1991 | Balaton | 5/710 |
| 5,195,199 | 3/1993 | Sereboff | 5/654 |
| 5,257,429 | 11/1993 | Genis . | |

*Primary Examiner*—Alexander Grosz

*Attorney, Agent, or Firm*—Fish & Richardson P.C.

[57] ABSTRACT

Hydraulic pillow has an upper water-filled cavity divided into various compartments, preferably four compartments which communicate between each other by means of a channel or tubing, the first compartment being slightly larger and having a concave recess in its outer surface. The pillow also has a lower cavity similar to the former cavity but filled with air and providing for the regulation, by means of a valve, of the height and firmness of the pillow.

2 Claims, 1 Drawing Sheet

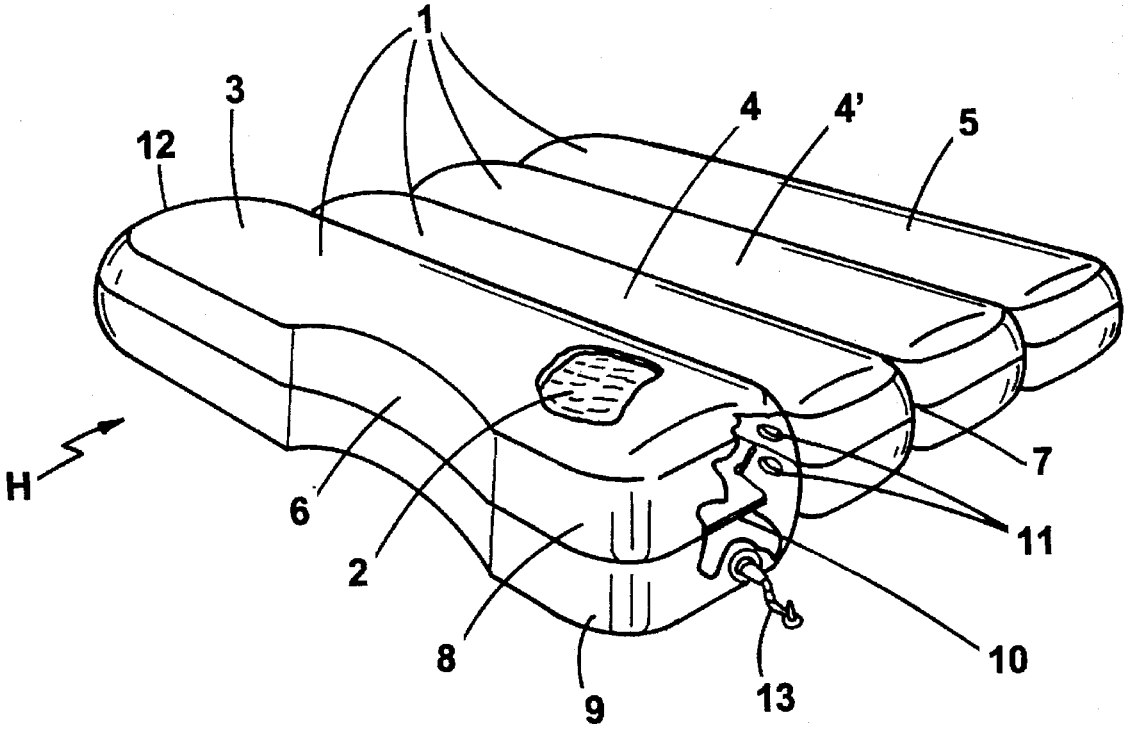
FIGURE

HYDRAULIC PILLOW

OBJECT OF THE INVENTION

This invention, as described and in the form expressed by this specification, consists of an hydraulic pillow the main therapeutic aim of which is the well—being, prevention and relief of pain in the area of the neck and upper cervical part of the vertebral column, preventing undesirable postures while the user is asleep, benefiting their rest by a clear relaxing effect. It stands out due to its utility in the field of respiratory allergies, this mainly being due to the absence of surface capillaries which could otherwise hold dust particles or microorganisms.

Given the special and unique characteristics of the pillow, which arise due to the nature of its structure, it offers constant anatomical adaptation to the area at which it is applied, eliminating a high proportion of noise due to its internal mass, mainly those subsonic frequencies transmitted through constructions and the ground, and which often cause alterations to the rest of individuals. Nor should it be overlooked that thanks to its high thermal conductivity it is able to dissipate the excess heat generated by the human organism more quickly, this finding important usage in the reduction of temperature in high fevers, while it also offer an extraordinary physiological sensation of pleasant freshness.

The following uses and characteristics should be underlined:

Muscular relaxation.

The correction, prevention and relief of pain in the neck and cervical part of the vertebral column.

A reduction and stabilization of body temperature, fevers, etc.

A highly specific indication in cases of respiratory allergy, asthma, etc.

Excellent noise reduction properties.

Constant adaptation to the anatomical area to which it is applied.

Easily cleaned and disinfected using alcohol soaked cotton wool.

THE BACKGROUND OF THE INVENTION

From the earliest times, man has tried to find the best possible forms of resting, as this restores the individual from one day to the next, in both psychological and physiological terms.

It is clear that a good rest is fundamental for activity and preparation for everyday tasks. Nevertheless, for this purpose good food and physical condition, together with an agreeable environment, are not enough. One ultimate factor is necessary—a suitable amount of rest.

Over recent times, men have been obliged to create environments and devices to combat the adverse conditions surrounding them. These conditions include noise pollution, lack of order in the timetable of the day, deficient living quarters, etc.). Most remedies involve taking pharmaceutical products, with all their side effects, or doubtful quack medicines to be able to get the rest desired. Although it is clear that this type of situation is changing in the context of our civilization, due to the supply of suitable information available to each individual, this change is not always easily accepted because of the additional effort and will-power that are necessary.

Being able to rest properly, especially at night, means health, as when the body and the brain in turn are rested this increases the amount of blood available to the brain, with a higher level of oxygenation and regeneration of cells, etc. For this, an environment suitable for each individual is necessary, as well as a suitable surface on which to rest, good conditions of hygiene, the absence of noise, and suitable temperature and atmosphere.

The nature of the above problems change, depending on local customs and the geographical area of each society. Nevertheless, needs are generally uniform in terms of the surface used for resting, in terms of its shape and structural composition. This generally tends to be composed of a platform and a head part, which must not change or harm the vertebral column, but rather constantly adapt to the whole surface with which they are in contact. Nor should they be a source of dust and contaminating particles which may give rise to alterations in the respiratory system, this often being the case and mainly for the part on which the head rests (pillows) made of feathers, flock (cotton, wool or synthetic fibres) and plastic foams having an open cellular structure (polyurethane, polyester, etc.). All of which are perfect environments for microorganisms and dust particles, which then go on to be deposited within the respiratory system of the individual in question, and all of this being contraindicated for those who suffer from asthma, allergies, respiratory problems, etc.

DESCRIPTION OF THE INVENTION

To be able to attain the above-mentioned objectives in a satisfactory and economical manner, the hydraulic pillow has been constructed according to the aims of the invention, and is designed to fully solve these problems in a fully satisfactory and totally new way, offering a structure that at the same or a lower price gives better results than pillows which are currently available on the market.

More specifically, the hydraulic pillow consists of a single or compound body, with a single cavity or several interconnected ones for holding the liquid, duly stabilised to ensure prolonged leakproofness (water, oils, etc.) forming a single whole and giving the object of the invention as its result.

The materials employed are to be sufficiently consistent (impermeable) to be able to hold the liquid, and sufficiently flexible to be able to offer better adaptation and comfort in usage, and may be of any composition or nature, on condition that they comply with the aforesaid requisites.

As a complementary feature, an additional chamber will be available for affixing to the underside of the pillow, thereby allowing users to adjust its height and hardness as they wish, this solution being activated pneumatically.

For an improved external finish, and as an accessory to this invention, it is to be accompanied by a textile sheath composed of two completely different surfaces, one for summer use and one for winter.

DESCRIPTION OF THE DRAWINGS

As an addition to this description, and with the aim of aiding towards a better understanding of the characteristics of this invention, this specification is accompanied by a single sheet of drawings as an integral part of the same, in which merely in the form of an illustration and in no manner as a limitation, an example of the invention is shown in perspective view.

THE PREFERENTIAL EMBODIMENT OF THE INVENTION

It may be observed in the said drawing that the hydraulic pillow consists of four containers (1) interconnected between each other (7) and divided within themselves by a horizontal membrane (10) across their whole width to separate the (duly stabilised) liquid they contain (2) in the upper cavity (8) from the air in the lower cavity (9). Each recipient, similar in size and interconnected (7) may be completely or partially cubic, parallelepiped, cylindrical, ellipsoid, toric, etc. in aspect and form, while the first container (3) is slightly larger than the others (4 and 5) and incorporating a frontal concave depression (6) with its axis approximately at the same place as that of the said container (3). All of which (1) is constructed of flexible and dense plastic material to ensure that it is completely leak-proof.

The largest container (3) together with the two others beside it (4) improve the essential nature of the invention, preshaping an anatomical shape for the neck and head, while the remaining or last container (5) is used to receive the liquid (2) displaced by the light pressures exerted by the said head and neck from the other containers (4 and 5).

The lower cavity (9) separated by the horizontal membrane (10) has the single purpose of ensuring improved adaptation of the hydraulic pillow, with the complementary use of being able to finely adjust the height of the pillow or otherwise the hardness of the same pneumatically by the valve in the form of a safety mouthpiece (13) and located at the lower part of the first larger container (3 and 9).

For greater comfort and to facilitate the transpiration of the skin, a textile cover must be used, this being composed of two completely different surfaces, one of fine fabric and the other thicker, or composed of several layers of textile.

It is not considered necessary to make this description any longer, as any expert in this field will understand the scope of the invention and the advantages deriving from the same.

The materials, shape, size and arrangement of the different elements are liable to variation, on condition that such alteration does not give rise to any change in the essential nature of the invention.

The terms in which this specification has been drawn up must always be taken in a broad and not a restrictive sense.

I claim:

1. A hydraulic pillow having a parallelepiped shape with slightly curved-convex faces and curved edges, said pillow comprising:

an upper liquid-filled cavity divided into a plurality of upper compartments in communication with each over by means of tubing interconnecting said plurality of upper compartments, said tubing disposed at most distant internal edges of said plurality of upper compartments, thereby attaining distribution of liquid among said plurality of upper compartments and restricting rapid travel of the liquid from one side of said hydraulic pillow to another side of said hydraulic pillow, a lower cavity divided into a plurality of lower compartments in communication with each over by means of tubing interconnecting said plurality of lower compartments, said tubing disposed at most distant internal edges of said plurality of lower compartments, thereby attaining distribution of air among said plurality of compartments and restricting rapid travel of the air from one side of said hydraulic pillow to another side of said hydraulic pillow, and said lower cavity having a valve in the form of safety mouthpiece located at a bottom region of said cavity for pneumatic adjustment of height and/or hardness characteristics of said hydraulic pillow for anatomical adaptation to a user's neck, head and respiratory system, and corresponding first compartments of said upper cavity and said lower cavity are relatively slightly larger than other compartments of said upper cavity and said lower cavity and define a concave depression in a frontal surface approximately at an axis, said concave depression contributing to attaining anatomical preshaping for a human body part to which said hydraulic pillow is applied.

2. The hydraulic pillow of claim 1 wherein said upper liquid-filled cavity is divided into four upper compartments, and said lower cavity is divided into four lower compartments.

* * * * *